United States Patent [19]

Lautenschläger

[11] Patent Number: 4,499,631

[45] Date of Patent: Feb. 19, 1985

[54] FURNITURE HINGE PERMITTING DOOR OPENING ANGLE OF 110 DEGREE OR MORE

[75] Inventor: Gerhard W. Lautenschläger, Brensbach, Fed. Rep. of Germany

[73] Assignee: Karl Lautenschläger KG, Möbelbeschlagfabrik, Reinheim, Fed. Rep. of Germany

[21] Appl. No.: 631,016

[22] Filed: Jul. 17, 1984

Related U.S. Application Data

[63] Continuation of Ser. No. 337,086, Jan. 4, 1982, abandoned.

[30] Foreign Application Priority Data

Mar. 5, 1981 [DE] Fed. Rep. of Germany ..... 3108224

[51] Int. Cl.[3] ..... E05D 3/06

[52] U.S. Cl. ..... 16/370

[58] Field of Search ..... 16/282, 288, 294, 302, 16/311, 365, 370

[56] References Cited

U.S. PATENT DOCUMENTS

| | | | |
|---|---|---|---|
| 3,611,474 | 10/1971 | Meyer | 16/370 X |
| 4,247,965 | 2/1981 | Lautenschläger | 16/294 |
| 4,389,748 | 6/1983 | Grossman | 16/302 |

FOREIGN PATENT DOCUMENTS

| | | | |
|---|---|---|---|
| 2109485 | 9/1972 | Fed. Rep. of Germany | 16/370 |
| 784387 | 7/1935 | France | 16/370 |
| 1128598 | 9/1968 | United Kingdom | 16/370 |

*Primary Examiner*—Fred A. Silverberg

[57] ABSTRACT

Furniture hinge (10) in the form of a four-joint hinge whose door-related part constructed as a recess-mounting cup (12) is pivotingly coupled by a four-joint mechanism formed by two hinge links (14;16) to a carcass-related hinge part which can be fastened to the carcass of a cabinet. One of the hinge links (14) is wider than the other hinge link (16) and, in the area between its ends, the wider hinge link (14) has an opening (38) whose width is equal to or greater than the width of the narrower hinge link (16). Therefore, when the hinge is in the open state, a portion between the ends of the narrower hinge link (16) can enter into the opening (38) in the wider hinge link (14), so that a larger opening angle is achieved than in the case of conventional four-joint hinges.

1 Claim, 6 Drawing Figures

Fig. 4
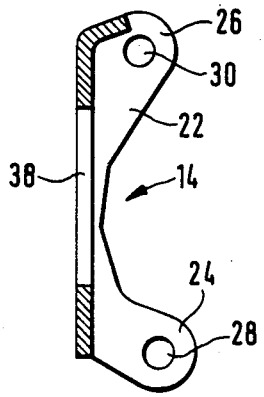
Fig. 3
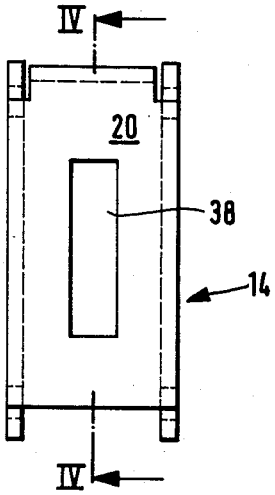
Fig. 5
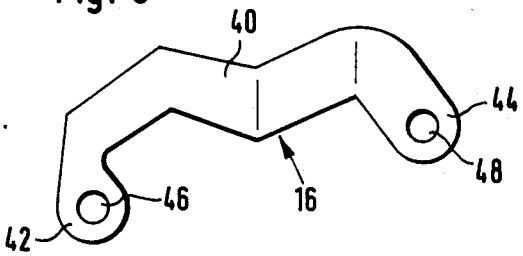
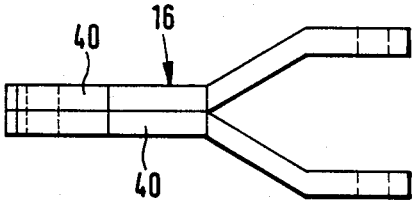
Fig. 6

FURNITURE HINGE PERMITTING DOOR OPENING ANGLE OF 110 DEGREE OR MORE

This application is a continuation of application Ser. No. 337,086, filed Jan. 4, 1982, now abandoned.

BACKGROUND

The invention relates to a cabinet hinge having a door-related part in the form of a cup which can be sunk and fastened in a recess in the back of a door leaf and a carcass-related part which can be fastened to the carcass of the cabinet, the two parts being coupled together by two hinge links journaled at their extremities, in the manner of a quadruple articulation, in the cup at the one end and on the carcass-related part at the other, one of the hinge links being made wider than the other hinge link and having in the area situated between its extremities an opening which is equal to the width of, or slightly wider than, the narrower hinge link.

Four-joint hinges are widely used in modern furniture construction and in many different versions for mounting doors to the carcass of pieces of furniture, especially cabinets. With the known four-joint hinges, door opening angles of usually 90° and in special cases to no more than 110° have been achieved. For larger opening angles, however, special wide-angle hinges of much more complex construction are used, in which the door-related part is coupled to the carcass-related part by a crosslink mechanism. Such crosslink hinges do, however, permit door opening angles of as much as 180°.

THE INVENTION

It is the object of the invention to improve the known four-joint hinges such that door leaves mounted on them can be opened appreciably more than 110°.

Setting out from a cabinet hinge of the kind mentioned above, this object is accomplished in accordance with the invention in that the narrower hinge link is formed such that, when the hinge opens, a portion of the narrower link that is situated between its extremities is able to pass through the opening in the wider hinge link. While in the known four-joint hinges, the opening movement ends when the two hinge links come into contact with one another, the hinge constructed in this manner can be opened still further because the narrower hinge link, when it reaches the position in which the opening movement of a conventional four-joint hinge ends, can still pass into the opening in the wider hinge link or even pass partially through same. In this manner opening angles of more than 130° can be achieved. Since the portion of the narrower hinge link entering into the opening can then abut against the edges of the wider hinge link laterally defining the opening, any bending of the narrower hinge link by the weight of the door leaf is securely prevented, so that the hinge of the invention is suitable even for heavier doors.

In a four-joint hinge opening to an angle of up to 90°, a configuration of the kind mentioned above is known from British Pat. No. 1,128,598 in which the outer hinge link has an opening, but when the hinge is opened, the opening does not accommodate a portion of the inner hinge link, but instead a special pin projecting from the inner hinge link engages in the opening in order thus to form a stop which, unlike the object to which this invention is addressed, is intended to prevent the hinge from opening past 90°.

Preferably, the outer hinge link farther from the cabinet carcass is the wider hinge link, in which case the configuration is then best made such that the outer hinge link is stamped out of sheet metal and has the form of a substantially planar elongated piece having lug-like projections bent away at right angles from the lateral edges, in which projections the bores are provided for the hinge pins whereby the links are journaled on the hinge mounting cup at one end and on the carcass-related hinge part at the other.

The inner hinge link nearer to the carcass of the cabinet is then best composed of two metal stampings of identical shape disposed parallel to the lug-like projections of the outer hinge link, which are provided in their end portion with the bores for journaling on the hinge cup at one end and on the carcass-related hinge part on the other.

The metal stampings of the inner hinge link are then lying directly against one another, at least in the portion that enters into the opening when the hinge is open, so that the opening in the outer hinge link can be made relatively narrow.

The invention will be further explained in the following description of an embodiment, in conjunction with the drawing, wherein:

FIG. 3 is a view of the wider, outer hinge link of the hinge of the invention, as seen in the direction of the arrow 3 in FIG. 1;

FIG. 4 is a side view as seen in the direction of the arrows 4—4 of FIG. 3;

FIG. 5 is a side view of the inner hinge link of the hinge shown in FIGS. 1 and 2, and FIG. 6 is a plan view of the hinge link shown in FIG. 5.

Figure 1:
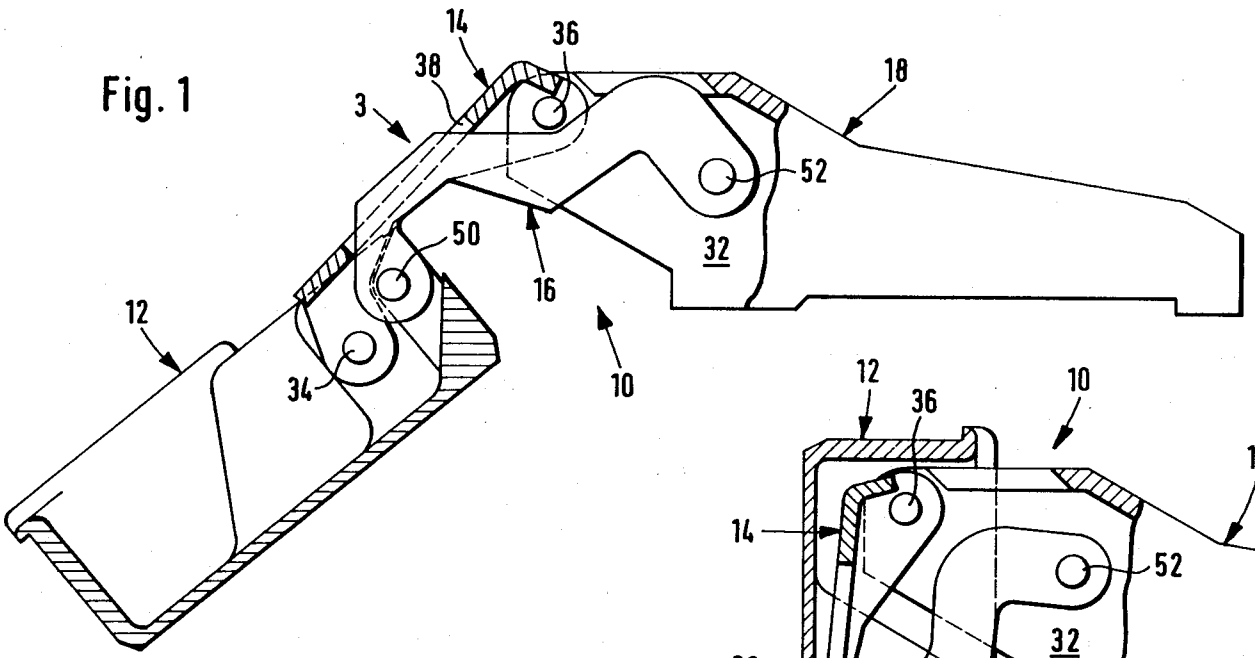
FIG. 1 is a side view, partially cut away along the longitudinal central plane, of a hinge in accordance with the invention in the maximum open position.
Figure 2:
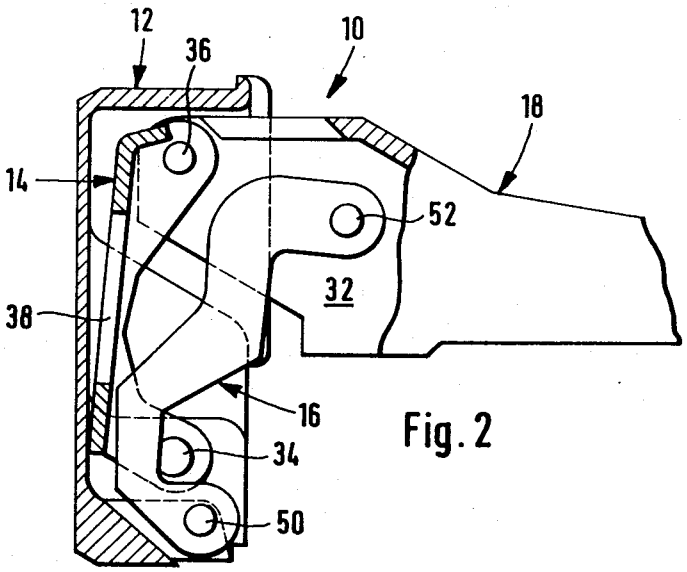
FIG. 2 is a view corresponding to FIG. 1, taken through the hinge of the invention, as seen in the closed position.

The hinge of the invention, designated as a whole as 10 in FIGS. 1 and 2, has a door-related part in the form of a cup 12 which can be fastened in a recess in the back of a door leaf, this hinge part being coupled by two hinge links 14 and 16 to a carcass-related hinge part 18 constructed in this case as an elongated supporting arm, which can be fastened adjustably, in a known manner, to a mounting plate (not shown) affixed to the carcass of the piece of furniture. The outer hinge link 14, i.e., the one farther from the carcass and represented separately in FIGS. 3 and 4, is in the form of an elongated planar metal stamping 20 having parallel sides, which is reinforced by lug-like projections 22 bent at right angles from the sides. The lug-like projections 22 are each enlarged in their end portions to form lugs 24 and 26 into which pin bores 28 and 30 are punched, through which the hinge pins 34 and 36 are passed when they are inserted through the cup 12 and through the sides 32 of the carcass-related hinge part 18 for the assembly of the hinge. In the planar portion 20 of the hinge link 14, an elongated, narrow opening 38 is stamped approximately in its center.

The hinge link 16 that is nearer to the carcass and represented separately in FIGS. 5 and 6, is composed of two metal stampings 40 disposed parallel to the projections 22 of the outer hinge link 14, and having the shape represented in FIG. 5, composed of a plurality of straight sections set at angles to one another. At the ends of the metal stampings 40, lugs 42 and 44 are again formed, into which bores 46 and 48 are punched which receive the hinge pins 50 and 52 which are mounted, one in the cup 12 and the other in the sides 32 of the carcass-related hinge part 18.

As it can be seen in FIG. 6, the left halves of the two metal stampings 40 associated with the cup 12 are placed closely together, and therefore in this portion they have such a narrow width that the hinge link 16 is able to enter at this portion into the opening 38 in the hinge link 14. This is the case in the open state of the hinge shown in FIG. 1. Thus the cup 12 can be swung further in the opening direction than would be the case without the opening 38 in the hinge link 14, because then the hinge link 16 would be able to move only to the point where it comes in contact with the confronting surface of the hinge link 14.

In the half associated with the carcass-related hinge part 18, however, the metal stampings 40 are bent twice in opposite directions such that their pivot eyes 44 associated with the carcass-related hinge part 18 are at a distance from one another corresponding approximately to the free inside dimension between the sides 32.

Modifications and further developments of the described embodiment can be realized within the scope of the invention, such modifications relating, for example, to the special configuration of the door-related part and/or the carcass-related part of the hinge. If, for example, the hinge is to be used for a cabinet having a frame restricting the free opening in the cabinet, the carcass-related part, instead of being, as represented, in the form of an elongated supporting arm, can be modified such that it will be suitable for mounting on the door frame.

I claim:

1. A hinge having a door-related part in the form of a cup having a bottom and to be sunk in a recess in a door leaf, and a carcass-related part to be fastened to a carcass of a cabinet, said hinge being movable through an angle of at least 110° from a closed position to an open position and vice versa, first and second hinge links coupling said carcass-related part to said door-related part without said hinge links being pivotally connected to each other, each hinge link having one end journalled at the cup and another end journalled at the carcass-related part, said first hinge link being closer to said bottom than said second hinge link when said hinge is in said closed position and having between its ends an opening of a certain width, said one end of said second hinge link being narrower than the width of said opening in said first hinge link, whereby part of said one end of said second hinge link passes through said opening when said hinge is moved from said closed position to said open position, wherein all the journalled ends of the hinge links remain on the same side of the opening in all positions of the hinge links, wherein said first hinge link is stamped out of sheet metal and is in the form of a substantially planar elongated metal stamping having at least at its ends lug-like projections bent at right angles from lateral edges of the hinge link, and pivot bores being provided for hinge pins journaling said first hinge link at the cup and at the carcass-related hinge part, respectively, wherein said second hinge link is composed of two sheet metal stampings of substantially equal form and disposed parallel to the lug-like projections of the first hinge link, said stampings being provided at end portions with aligned pivot bores for hinge pins journaling said second hinge link at the cup and at the carcass-related hinge part, respectively, wherein said metal stampings of the second hinge link lie directly against one another at said one end and only said two sheet metal stampings enter into and partially pass through said opening in the first hinge link.

* * * * *